US011659340B2

(12) United States Patent
Chen et al.

(10) Patent No.: US 11,659,340 B2
(45) Date of Patent: May 23, 2023

(54) IMPULSIVE NOISE SUPPRESSION METHOD AND SYSTEM BASED ON DUAL-MICROPHONE ARCHITECTURE

(71) Applicant: Shenzhen Muxin Technology Co., Ltd., Guangdong (CN)

(72) Inventors: Zhuo Chen, Guangdong (CN); Bo Tan, Guangdong (CN)

(73) Assignee: Shenzhen Muxin Technology Co., Ltd., Guangdong (CN)

( * ) Notice: Subject to any disclaimer, the term of this patent is extended or adjusted under 35 U.S.C. 154(b) by 0 days.

(21) Appl. No.: 17/537,523

(22) Filed: Nov. 30, 2021

(65) Prior Publication Data

US 2022/0337959 A1 Oct. 20, 2022

(30) Foreign Application Priority Data

Apr. 16, 2021 (CN) ..... 202110412930.8

(51) Int. Cl.
*H04R 25/00* (2006.01)

(52) U.S. Cl.
CPC ..... *H04R 25/505* (2013.01)

(58) Field of Classification Search
CPC .. H04R 25/505; H04R 3/005; H04R 2410/05; H04R 25/00; H04R 2203/00; H04R 2225/43
See application file for complete search history.

(56) References Cited

U.S. PATENT DOCUMENTS

| | | | | |
|---|---|---|---|---|
| 2013/0102259 | A1 | 4/2013 | Son | |
| 2016/0316303 | A1* | 10/2016 | Kornagel | G10L 21/0232 |
| 2018/0234760 | A1 | 8/2018 | Chen | |
| 2019/0158963 | A1* | 5/2019 | Best | H04R 25/505 |
| 2020/0221236 | A1* | 7/2020 | Jensen | H04R 25/505 |

FOREIGN PATENT DOCUMENTS

| | | | |
|---|---|---|---|
| CN | 102254563 | A | 11/2011 |
| CN | 106157967 | A | 11/2016 |
| CN | 110503973 | A | 11/2019 |
| CN | 112037806 | A | 12/2020 |
| CN | 112802486 | A | 5/2021 |
| WO | 2009/102141 | A2 | 8/2009 |

* cited by examiner

*Primary Examiner* — Tuan D Nguyen
(74) *Attorney, Agent, or Firm* — Winston Hsu

(57) ABSTRACT

The present invention provides an impulsive noise suppression method based on dual-microphone architecture, applied to a hearing aid comprising a first feedforward microphone, a second feedforward microphone, and a speaker, and a sensitivity level of the first feedforward microphone is less than a sensitivity level of the second feedforward microphone, wherein the method comprising: obtaining an input signal comprising a first signal provided through the first microphone and a second signal provided through the second feedforward microphone; determining whether the input signal comprises an impulsive signal according to a first time-domain signal energy value of the first signal and a second time-domain signal energy value of the second signal; and performing an impulsive signal suppression operation on the input signal if the input signal comprises the impulsive signal. The technical scheme provided by the present invention has a simple calculation process, low calculation resource consumption, and fast response speed.

17 Claims, 13 Drawing Sheets

IMPULSIVE NOISE SUPPRESSION METHOD AND SYSTEM BASED ON DUAL-MICROPHONE ARCHITECTURE

BACKGROUND OF THE INVENTION

1. Field of the Invention

The present invention relates to a field of speech processing and more particularly to an impulsive noise suppression method based on dual-microphone architecture, system, computing device, and computer-readable storage medium.

2. Description of the Prior Art

With the development of electronic devices, hearing devices (such as headphones or hearing aids) have been developed to supplement the hearing loss of hearing-impaired individuals. The hearing devices are usually installed in the user's ear to amplify the sound and provide the amplified sound to the wearer. The hearing devices usually include a microphone that collects input signals; a processor for amplifying an input signal; and a speaker (which may be referred to as a receiver in the field of hearing aids) that outputs sound.

In hearing device wear, when the external ambient signal is small or the sound source is far away from the hearing device, it needs to be amplified because of its relatively weak energy intensity when it reaches the microphone. However, linear amplification will lead to new problems. For example, when the amplification reaches a certain degree, if an input signal is or includes an impulsive signal, the gain of the signal itself may reach 100 dB or even more energy. At this time, the amplification of the hearing device will lead to a signal with a very large energy amplitude to be output, thus causing damage to the hearing.

To solve the above problem, usually directly using WDRC (Wide Dynamic Range Compression) algorithm or AGCO (Automatic Gain Control), the relatively weak signal is amplified, while the higher-energy signal is performed on for a certain degree of suppression, so that the headphone wearer can produce a better hearing experience. However, the above methods are complex processing of all signals directly in the frequency domain, which consumes a lot of computing resources and slow response time, and takes a relatively long time to complete the processing.

SUMMARY OF THE INVENTION

It is therefore an objective to provide an impulsive noise suppression method and system based on dual-microphone architecture to solve the above problem.

The present invention provides an impulsive noise suppression method based on a dual-microphone architecture, applied to a hearing aid, and the hearing aid comprises a first feedforward microphone, a second feedforward microphone, and a speaker, and a sensitivity level of the first feedforward microphone is less than a sensitivity level of the second feedforward microphone, wherein the first feedforward microphone and the second feedforward microphone are located on a side of the hearing aid away from an ear canal, and the speaker is located on a side close to the ear canal, wherein the method comprises obtaining an input signal, the input signal comprising a first signal provided through the first microphone and a second signal provided through the second feedforward microphone; determining whether the input signal comprises an impulsive signal according to a first time-domain signal energy value of the first signal and a second time-domain signal energy value of the second signal; and performing an impulsive signal suppression operation on the input signal if the input signal includes the impulsive signal.

The present invention further provides a computing device, comprising a first feedforward microphone; a second feedforward microphone, wherein a sensitivity level of the first feedforward microphone is less than a sensitivity level of the second feedforward microphone, and wherein the first feedforward microphone and the second feedforward microphone are located on a side of the computing device away from an ear canal, and the speaker is located on a side close to the ear canal; a speaker; at least one processor; and at least one memory communicatively coupled to the at least one processor to configure the at least one processor to: obtain an input signal, the input signal comprising a first signal provided through the first microphone and a second signal provided through the second feedforward microphone; determine whether the input signal comprises an impulsive signal according to a first time-domain signal energy value of the first signal and a second time-domain signal energy value of the second signal; and perform an impulsive signal suppression operation on the input signal if the input signal includes the impulsive signal.

The present invention further provides an impulsive noise suppression method based on a single-microphone architecture, applied to a hearing aid, wherein the hearing aid comprises a feedforward microphone and a speaker electrically connected in sequence, wherein the feedforward microphone is located on a side of the hearing aid away from an ear canal, and the speaker is located on a side close to the ear canal, and the method comprising obtaining an input signal through the feedforward microphone, the input signal comprising a signal provided from a surrounding environment; detecting whether the input signal comprises a time-domain impulsive signal; performing an output gain control on the input signal to obtain a first target signal if the input signal comprises the time-domain impulsive signal; performing a dynamic range companding control and the output gain control on the input signal in sequence to obtain a second target signal if the input signal does not comprise the time-domain impulsive signal; and outputting the first target signal or the second target signal to the speaker for playing through the speaker.

These and other objectives of the present invention will no doubt become obvious to those of ordinary skill in the art after reading the following detailed description of the preferred embodiment that is illustrated in the various figures and drawings.

DETAILED DESCRIPTION

To make the objectives, technical solutions, and advantages of the present application more comprehensible, the present application is described in further detail below with reference to embodiments and the accompanying drawings. It should be understood that the specific embodiments described herein are merely used for explaining the present application, and are not intended to limit the present application. All other embodiments obtained by those skilled in the art based on the embodiments of the present application without creative efforts shall fall within the protection scope of the present application.

It should be noted that the description of "first", "second" and the like in the present application is used for the purpose of description only, and cannot be construed as indicating or implying its relative importance or implicitly indicating the number of the indicated technical features. Thus, features defining "first" or "second" may include at least one of the features, either explicitly or implicitly. In addition, the technical solutions in the embodiments can be combined with each other, but must be based on the realization of those ordinary skilled in the art, when the combinations of the technical solutions are contradictory or unrealizable, it shall be deemed that the combinations of the technical solutions do not exist and are not within the protection scope required by the present application.

In the description of the present application, it should be understood that a numerical label before the steps does not identify the sequence of execution of the steps, and is only used to facilitate the description of the application and distinguish each step, and therefore cannot be understood as a limitation of the application.

Figure 1:
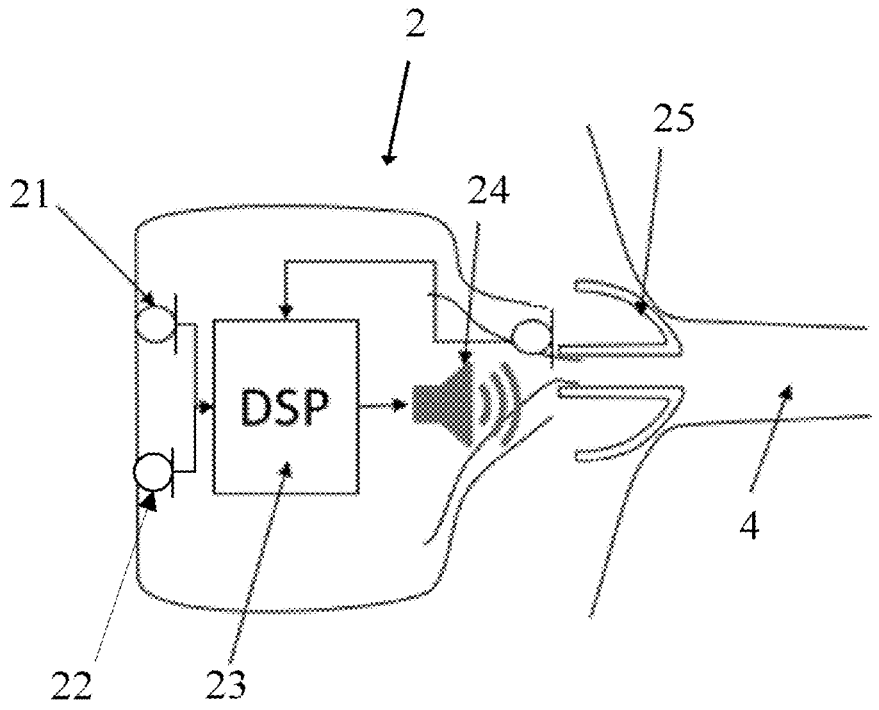
FIG. 1 schematically shows a structure diagram of a hearing aid of the present invention.

FIG. 1 schematically shows an environmental application diagram of an impulsive noise suppression method based on dual-microphone architecture according to an embodiment of the present invention.

The impulsive noise suppression method based on a dual-microphone architecture can be implemented in a hearing aid 2.

The hearing aid 2 comprises a housing, and the housing comprises a first feedforward microphone 21, a second feedforward microphone 22, a processor 23, and a speaker 24.

The first feedforward microphone 21 is located on a side of the hearing aid 2 away from an ear canal, and can be configured to obtain surrounding environment signals around a wearer.

The second feedforward microphone 22 is located on the side of the hearing aid 2 away from the ear canal (that is, located on the same side of the first feedforward microphone 21), and can be configured to obtain the surrounding environment signals around the wearer. A sensitivity level of the first feedforward microphone 21 is less than a sensitivity level of the second feedforward microphone 22. Wherein, the sensitivity level may comprise sound sensitivity level. The sensitivity level refers to an electrical response of an output end of the microphone to a given standard acoustic input. For a fixed acoustic input, the second feedforward microphone 22 with high sensitivity level outputs a higher electrical signal amplitude than the first feedforward microphone 21 with a low sensitivity level.

The processor 23 is electrically connected to the first feedforward microphone 21, the second feedforward microphone 22, and the speaker 24, and is configured to process signals provided by the first feedforward microphone 21 and by the second feedforward microphone 22. For example, impulsive noise suppression, wide dynamic range compression (WDRC), beamforming, etc. The processor 23 may be a DSP (Digital Signal Processing, digital signal processing) chip or the like.

The speaker 24 is configured to receive signals processed by the processor 23 and output processed signals to the ear canal 4.

A silicone sleeve 25 is configured to at least partially insert into the ear canal 4 when the hearing aid 2 is worn. The silicone sleeve 25 can block the surrounding sound around the wearer from entering the ear canal 4 to a certain extent. Of course, the material of the silicone sleeve 25 can be replaced.

The present invention can provide an impulsive noise suppression solution based on dual-microphone architecture according to the structure of the above-mentioned hearing aid. According to a first signal provided by the first feedforward microphone 21 and a second signal provided by the second feedforward microphone 22, it is determined that whether there is an impulsive signal. If there is an impulsive signal, an impulsive noise suppression operation is performed.

Of course, the invention also provides an impulsive noise suppression solution for single-microphone architecture (first feedforward microphone 21).

An implementation principle of the impulsive noise suppression scheme based on dual-microphone architecture is provided below.

Design idea: the first feedforward microphone and the second feedforward microphone with different sensitivity levels are used.

A duration of an impulsive signal may be between 10-200 ms, which needs to be detected in a range of tens of milliseconds at the fastest, and the processing of the impulsive signal is realized. Characteristics of the impulsive signal comprise: energy increases sharply to very large in a very short time.

Figure 2:
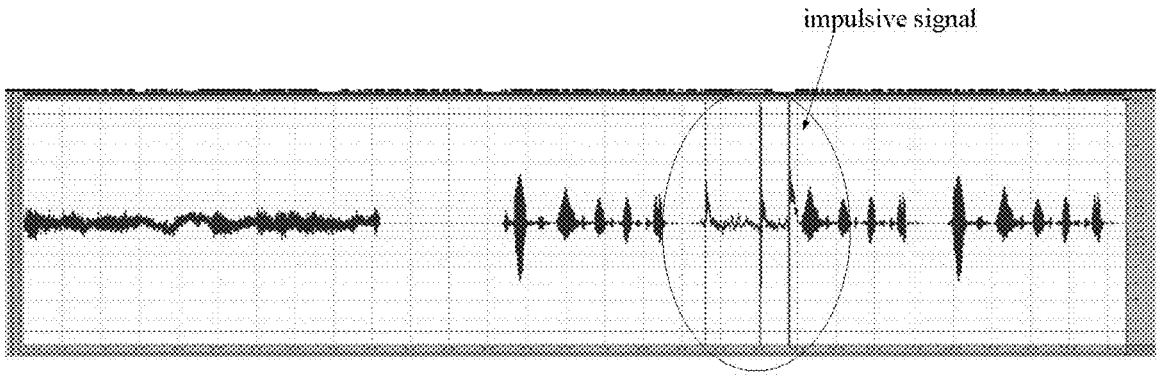
FIG. 2 is a signal time-domain diagram including an impulsive signal.

As shown in FIG. 2, for a microphone with a higher sensitivity level, its dynamic range will be reduced and a signal amplitude sent to the processor 23 will be larger. When the signal comprises an impulsive signal, the signal obtained by the processor 23 will be saturated.

Due to the saturation phenomenon, the amplitude of the impulsive signal obtained by the processor 23 from the second feedforward microphone 22 with a higher sensitivity level is limited. That is, a signal energy value of the impulsive signal obtained by the processor 23 from the second feedforward microphone 22 with the higher sensitivity level may be saturated. Therefore, a time-domain energy difference between the impulsive signal obtained by the processor 23 from the second feedforward microphone 22 with the higher sensitivity level and an impulsive signal obtained from the first feedforward microphone 21 with a lower sensitivity level will be reduced (e.g., less than a certain threshold). For example, the first feedforward microphone 21 adopts a microphone with a normal sensitivity level (for example, the sensitivity level is −38 dBv), and the second feedforward microphone 22 adopts a microphone with an ultra-high sensitivity level (for example, the sensitivity level is −23 dBv). Therefore, when the time-domain energy difference between the input signal obtained from the second feedforward microphone 22 with the higher sensitivity level and the input signal obtained from the first feedforward microphone 21 with the lower sensitivity level is less than 15 dB, it indicates that the impulsive signal may appear in the input signal. And, the lower the time-domain energy difference, the greater the probability of an impulsive signal.

Figure 3:
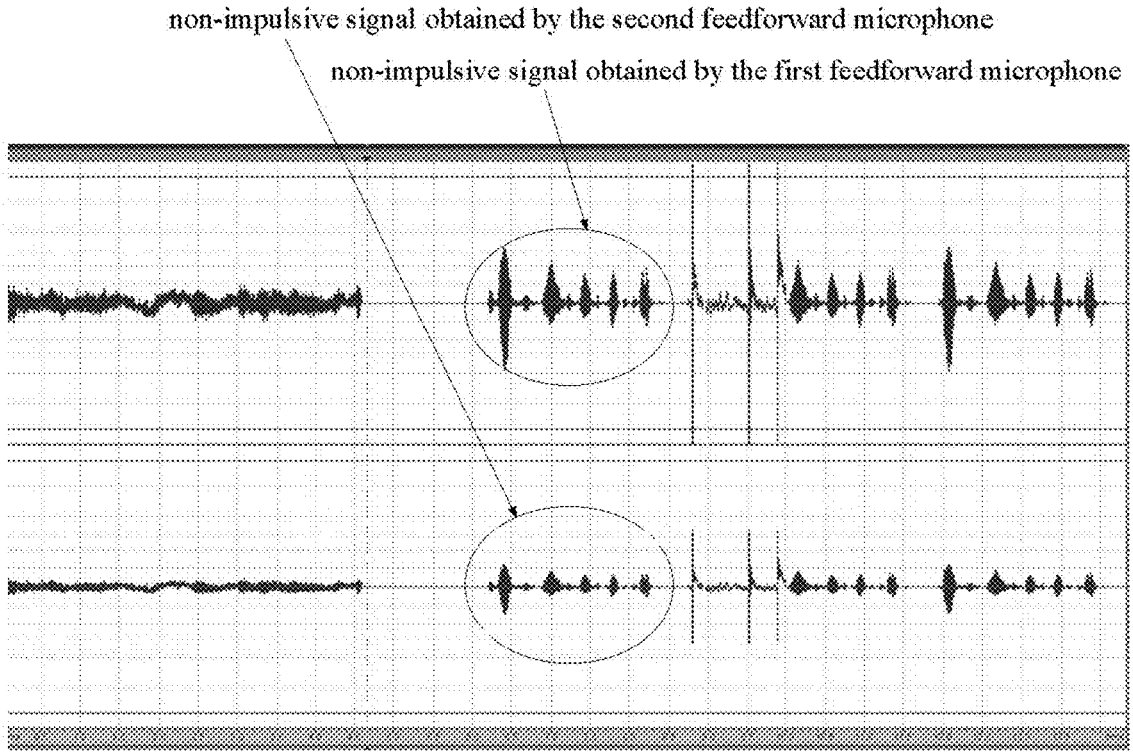
FIG. 3 is time-domain diagrams of signals provided by two feedforward microphones with different sensitivities.

As shown in FIG. 3, it shows a non-impulsive signal obtained by the first feedforward microphone 21 and a non-impulsive signal obtained by the second feedforward microphone 22 respectively. Since there is no problem of signal saturation, a time-domain energy difference (a ratio is relatively large) between the non-impulsive signal obtained from the processor 23 from the second feedforward microphone 22 with the higher sensitivity level and the non-impulsive signal obtained from the first feedforward microphone 21 with the lower sensitivity level is relatively large.

Figure 4:
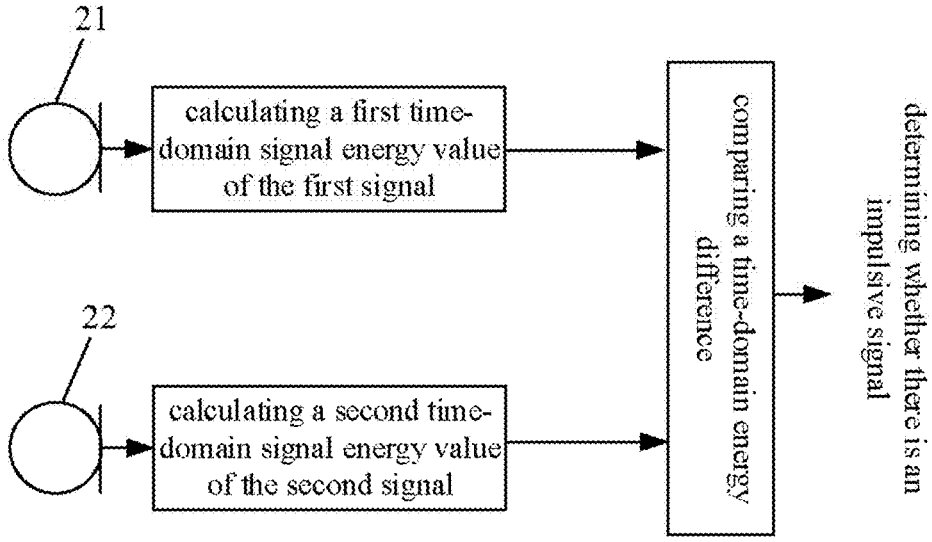
FIG. 4 is a process framework of impulsive noise suppression based on dual-microphone architecture.

Based on the above analysis, it can be determined whether there is an impulsive signal based on an energy ratio. The details are shown in FIG. 4:

(1) Obtaining a first signal through the first feedforward microphone 21 and calculating a first time-domain signal energy value of the first signal;

(2) Obtaining a second signal through the second feedforward microphone 22 and calculating a second time-domain signal energy value of the second signal;

(3) Comparing a time-domain energy difference between a time-domain signal energy value of the first signal and a time-domain signal energy value of the second signal, and determining whether there is an impulsive signal in the surrounding environment of the wearer through the time-domain energy difference.

If the time-domain energy difference is greater than a preset energy difference threshold (15 dB), it is determined that there is an impulsive signal.

Figure 5:
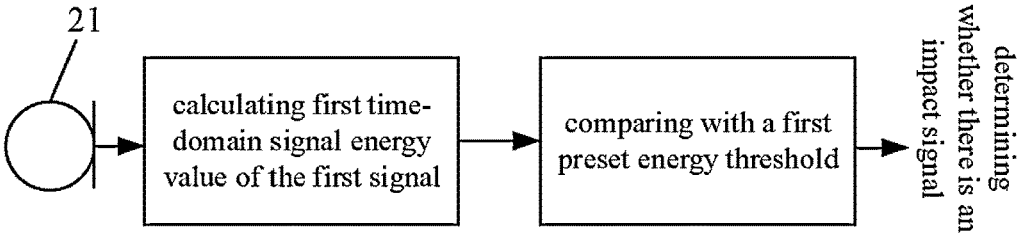
FIG. 5 is another process framework of impulsive noise suppression based on dual-microphone architecture.

Further, since the characteristics of the impulsive signal comprise: the energy increases sharply to very large in a very short time. Therefore when the impulsive signal appears in the surrounding environment, the output of the first feedforward microphone 21 will increase sharply. In view of this, as shown in FIG. 5, the present application can also determine whether an impulsive signal occurs through the first time-domain signal energy value of the first signal provided by the first feedforward microphone 21. For example, the first time-domain signal energy value of the first signal is higher than a first preset energy threshold (e.g., 100 dB).

It should be noted that the first preset energy threshold can be determined by the ambient noise detected by the first feedforward microphone 21. When the ambient noise detected by the first feedforward microphone 21 is low, the first preset energy threshold is low. When the ambient noise detected by the first feedforward microphone 21 is high, the first preset energy threshold is dynamically adjusted up.

Figure 6:
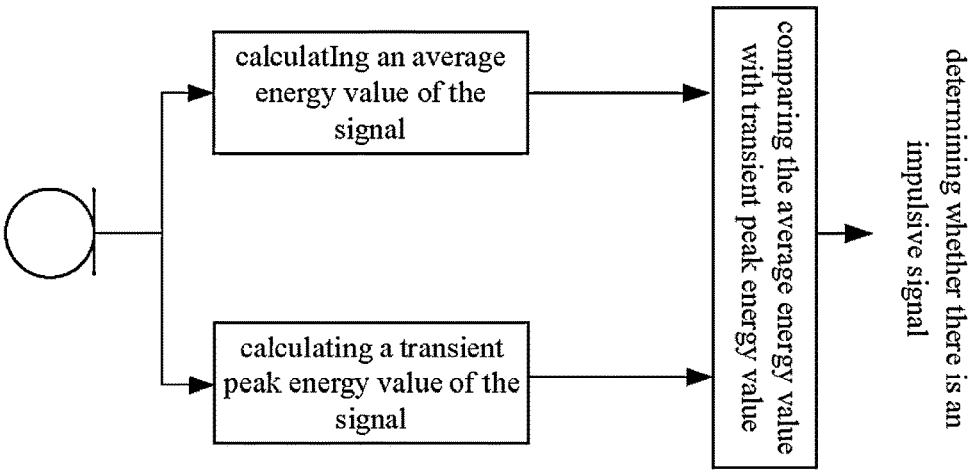
FIG. 6 is another process framework of impulsive noise suppression based on dual-microphone architecture.

Further, the inventor also found that when there is an impulsive signal, a transient peak energy value of the signal surges, and an average energy value of the signal increases relatively slowly. As shown in FIG. 6, the average energy value and transient peak energy value of the signal can be calculated, the time-domain energy difference between the average energy value and transient peak energy value of the signal can be calculated, and when the time-domain energy difference is greater than a certain threshold, it is determined that there is an impulsive signal. It should be noted that the above signal can be the first signal provided by the first feedforward microphone 21, also can be the second signal provided by the second feedforward microphone 22, or a combination of the two.

Figure 7:
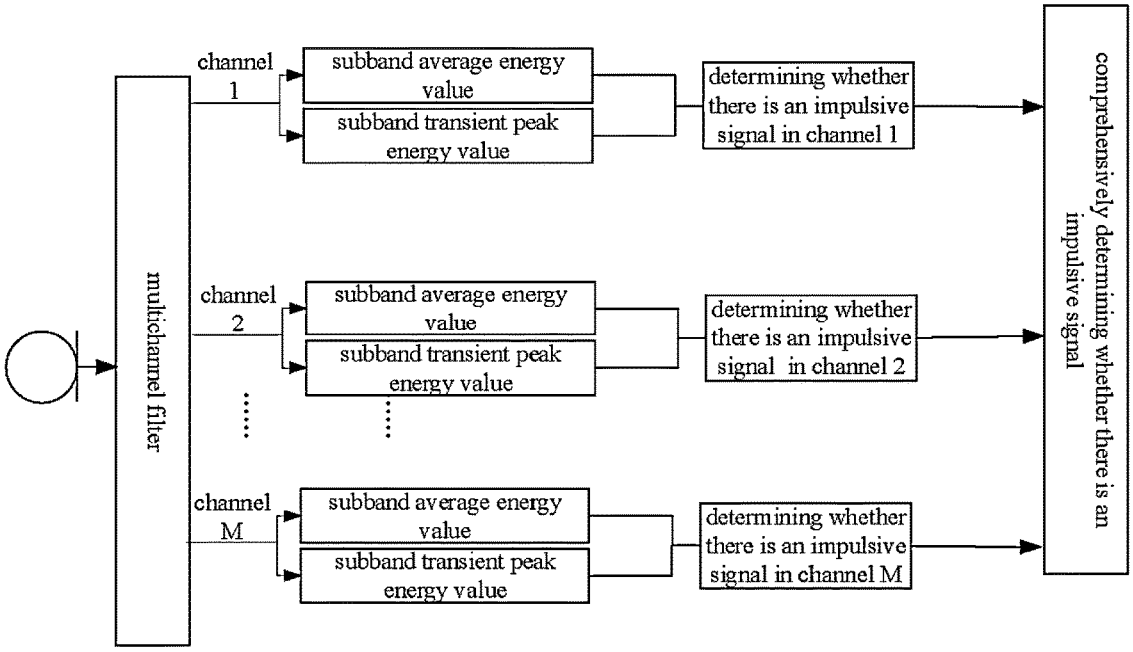
FIG. 7 is another process framework of impulsive noise suppression based on dual-microphone architecture.

In order to further improve the accuracy of determining whether there is an impulsive signal, as shown in FIG. 7, the signal can be divided into channels for analysis, and whether there is an impulsive signal in each channel can be determined through a subband signal in each channel. The details are as follows:

Step 1: performing multi-band filtering on the input signal (first signal or second signal) to obtain M subband signals corresponding to M channels;

Step 2: calculating a subband average energy value and a subband transient peak energy value of an i-th channel, i is a natural number, $1 \leq i \leq m$;

Step 3: determining whether there is an impulsive signal in the i-th channel according to the time-domain energy difference between the subband average energy value and the subband transient peak energy value of the i-th channel, so as to obtain M determination results corresponding to the M channels;

Step 4: determining whether the input signal comprises an impulsive signal according to the M determination results.

Further, the inventor found that:

Since a frequency range covered by the impulsive signal is the whole frequency band, and a voice is mainly concentrated in 300-3400 Hz.

Therefore, a weight value can be increased for a determination of channels above 4 kHz.

The weight value of a low-frequency part is low, which can effectively resist the interference of speech and make the determination of impulsive signals more robust.

Figure 8:
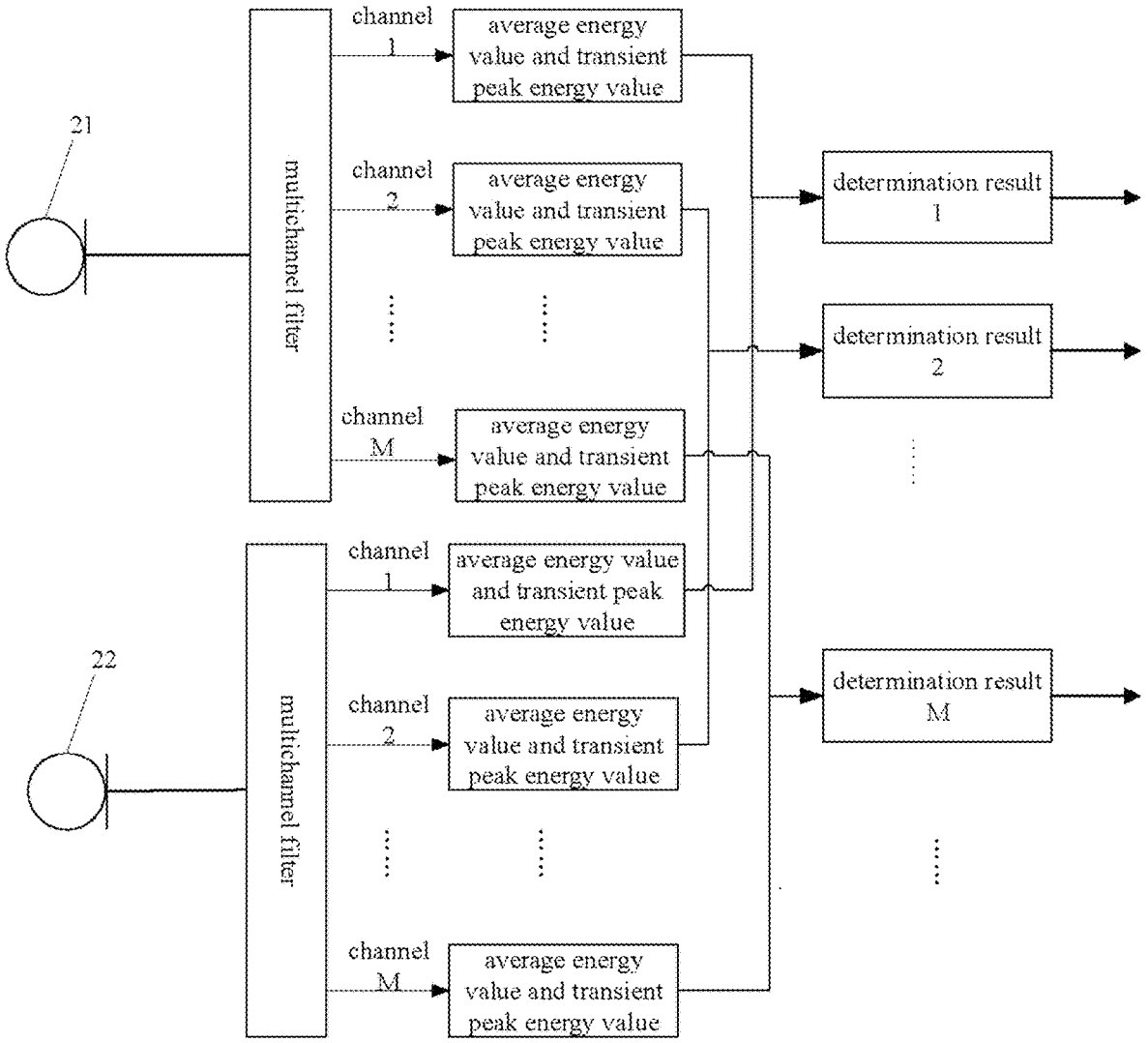
FIG. 8 is another process framework of impulsive noise suppression based on dual-microphone architecture.

In order to further improve the determination accuracy of the impulsive signal, as shown in FIG. 8:

Step 1: performing multi-band filtering on the first signal or the second signal respectively to obtain M first subband signals corresponding to M channels and M second subband signals corresponding to the M channels, wherein, M first subband signals are obtained according to the first signal, and M second subband signals are obtained according to the second signal.

Step 2: calculating a time-domain energy difference between the subband average energy value of the first subband signal and the subband transient peak energy value of the first subband signal in the i-th channel, and a time-domain energy difference between the subband average energy value of the second subband signal and the subband transient peak energy value of the second subband signal in the i-th channel, and obtaining an i-th determination result corresponding to the i-th channel, to obtain M determination results corresponding to the M channels, the i is a natural number, $1 \leq i \leq m$.

Step 3: configuring a weight value for each channel, a channel with a frequency higher than 4 kHz is configured with a higher weight value, and a channel with a frequency lower than 4 kHz is configured with a lower weight value.

Step 4: determining whether there is an impulsive signal comprehensively according to each of the M determination results and a corresponding weight value.

For example, when there is an impulsive signal, the corresponding determination result is 1. When there is no impulsive signal, the corresponding determination result is −1. The weight value of the channel with a frequency higher than 4 kHz is 0.5, and the weight value of the channel with a frequency lower than 4 kHz is 0.2. Wherein an influence of the determination result of each channel on the comprehensive determination is: the determination result*the weight value of the channel.

The above comprehensive weight value can be compressed by sigma and other functions to obtain a probability value between 0-1.

The higher the probability value, the greater the possibility of impulsive signal and the greater the degree of suppression of the input signal in the time domain.

The lower the probability value, the lighter the degree of suppression.

A plurality of embodiments will be provided below, each of which can be used to implement the impulsive noise suppression method based on the dual-microphone architecture described above. For ease of understanding, the hearing aid 2 will be exemplarily described below as the executive body.

Embodiment 1

In the embodiment, the impulsive noise suppression method based on dual-microphone architecture is applied to the hearing aid 2. As shown in FIG. 1, the hearing aid 2 comprises a first feedforward microphone 21, a second feedforward microphone 22, and a speaker 23, and the sensitivity level of the first feedforward microphone 21 is less than the sensitivity level of the second feedforward microphone 22, the first feedforward microphone 21 and the second feedforward microphone 22 are located on a side of the hearing aid 2 away from the ear canal 4, and the speaker 23 is located on a side close to the ear canal 4.

Figure 9:
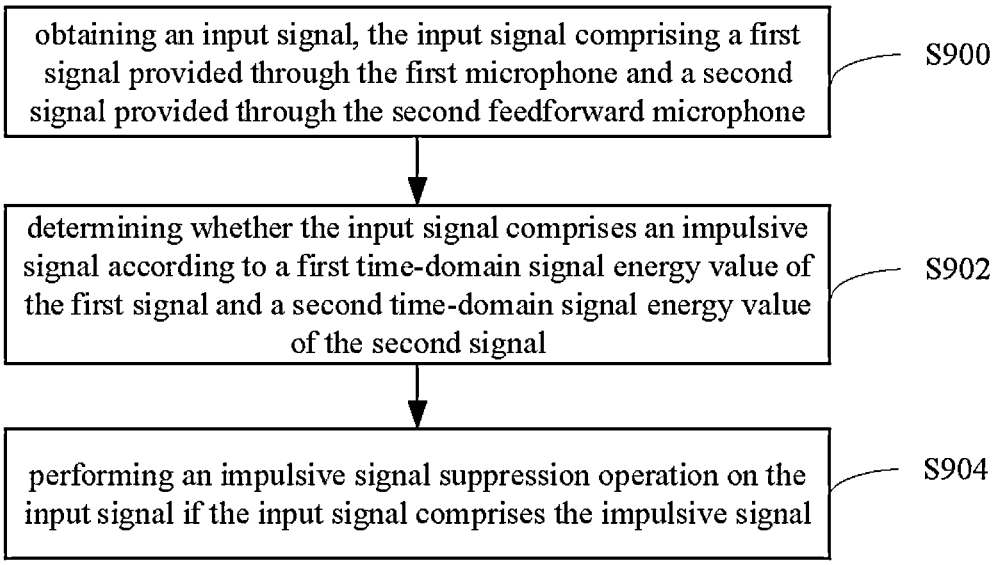
FIG. 9 schematically shows a flow chart of an impulsive noise suppression method based on dual-microphone architecture according to a first embodiment of the present invention.

FIG. 9 schematically shows a flowchart of an impulsive noise suppression method based on dual-microphone architecture according to a first embodiment of the present invention. As shown in FIG. 9, the impulsive noise suppression method based on dual-microphone architecture may comprise steps S900 to s906, wherein:

Step S900, obtaining an input signal, the input signal comprising a first signal provided through the first microphone and a second signal provided through the second feedforward microphone.

The first feedforward microphone 21 is configured to collect signals of the surrounding environment and can be a microphone with a normal sensitivity level, such as −38 dBv.

The second feedforward microphone 22 is configured to collect signals of the surrounding environment and can be a microphone with an ultra-high sensitivity level, such as −23 dBv.

The input signal is a signal input to the processor 23.

The input signal comprises the first signal and the second signal. The first signal is a signal output from the first feedforward microphone 21 to the processor 23. The second signal is a signal output from the second feedforward microphone 22 to the processor 23.

Step S902, determining whether the input signal comprises an impulsive signal according to a first time-domain signal energy value of the first signal and a second time-domain signal energy value of the second signal.

Step S904, performing an impulsive signal suppression operation on the input signal if the input signal comprises the impulsive signal.

The impulsive noise suppression method based on dual-microphone architecture provided by the embodiment of the present invention collects the signals of the surrounding environment based on the first feedforward microphone and the second feedforward microphone with different sensitivity levels to obtain the first signal and the second signal with a difference, and whether the input signal comprises an impulsive signal is determined by the first time-domain signal energy value of the first signal and the second time-domain signal energy value of the second signal, and the impulsive noise suppression is implemented. In the embodiment, whether there is an impulsive signal is analyzed through the time-domain signal energy value, a calculation process is simple, calculation resource consumption is small, and a response speed is fast, to ensure that the wearer has a better hearing experience.

There are various ways to determine whether the input signal comprises an impulsive signal, such as:

Method 1

Figure 10:
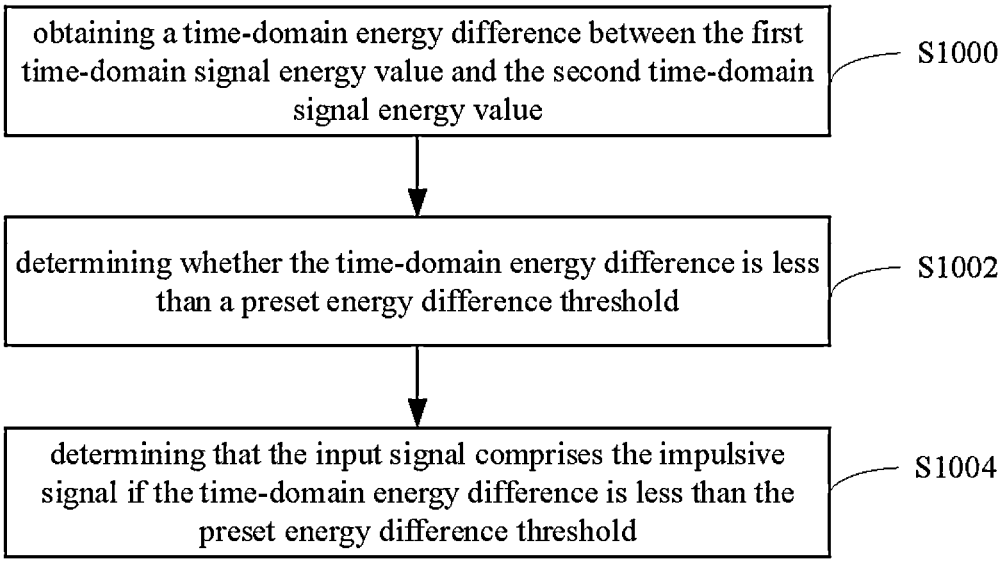
FIG. 10 is a flowchart of step S902 in FIG. 9.

As shown in FIG. 10, the step 902 can comprise steps S1002~S1004, wherein: step S1000, obtaining a time-domain energy difference between the first time-domain signal energy value and the second time-domain signal energy value; wherein the first time-domain signal energy value and the second time-domain signal energy value correspond to a same time window; step S1002, determining whether the time-domain energy difference is less than a preset energy difference threshold; and step S1004, determining that the input signal comprises the impulsive signal if the time-domain energy difference is less than the preset energy difference threshold. In the present embodiment, since the sensitivity level of the first feedforward microphone 21 is less than the sensitivity level of the second feedforward microphone 22, a signal amplitude of the second signal transmitted by the second feedforward microphone 22 to the processor 23 is greater than a signal amplitude of the first feedforward microphone 21. When the input signal comprises an impulsive signal, the signal amplitude of the first signal and the signal amplitude of the second signal will increase significantly. However, due to the higher sensitivity level of the second feedforward microphone 22, the signal amplitude of the second signal is saturated (limited), which may reduce the difference between the signal amplitude of the first signal and the signal amplitude of the second signal. It can be seen that the embodiment is used to determine whether the input signal comprises the impulsive signal through an obvious reduction of the time-domain energy difference.

Method 2 (a Further Scheme Based on the Method 1)

Figure 11:
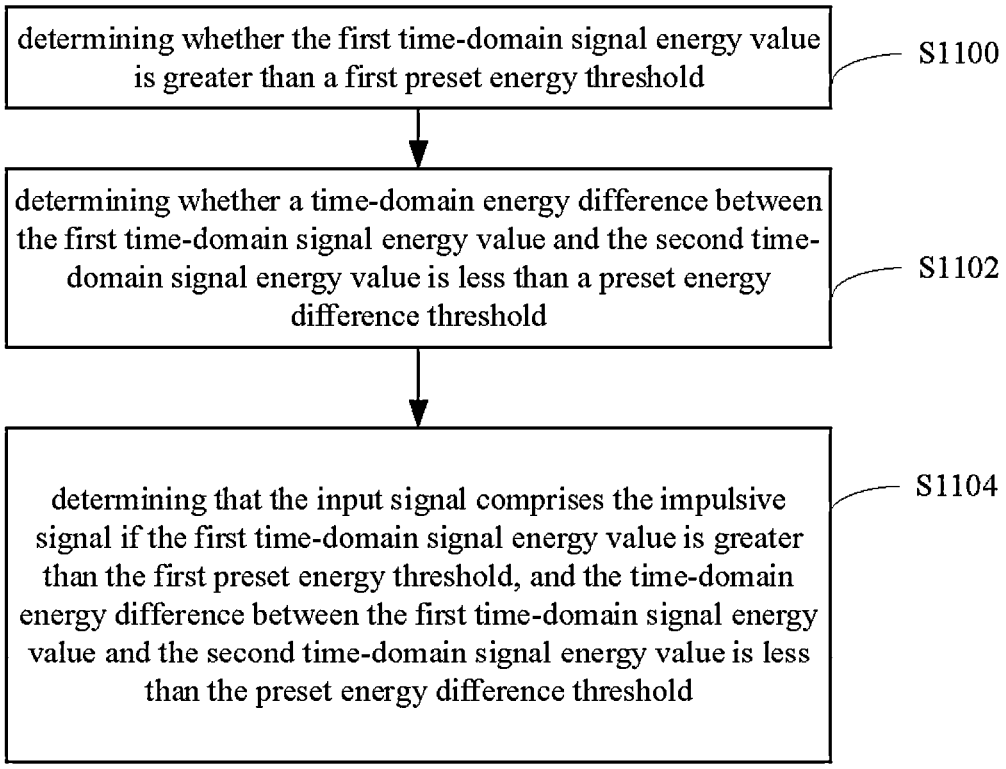
FIG. 11 is another flowchart of step S902 in FIG. 9.

As shown in FIG. 11, the step 902 can comprise steps S1100~S1104, wherein: step S1100, determining whether the first time-domain signal energy value is greater than a first preset energy threshold; step S1102, determining whether a time-domain energy difference between the first time-domain signal energy value and the second time-domain signal energy value is less than a preset energy difference threshold, and the first time-domain signal energy value and the second time-domain signal energy value correspond to a same time window; and step S1104, determining that the input signal comprises the impulsive signal if the first time-domain signal energy value is greater than the first preset energy threshold, and the time-domain energy difference between the first time-domain signal energy value and the second time-domain signal energy value is less than the preset energy difference threshold. In the embodiment, since characteristics of the impulsive signal comprise that the energy increases sharply to very large in a very short time, when the impulsive signal appears in the surrounding environment, the output of the first feedforward microphone 21 will increase sharply. Therefore, by integrating the time-domain energy difference and the first time-domain signal energy value, it is possible to more accurately determine whether the input signal comprises an impulsive signal. It should be noted that since the second time-domain signal energy value corresponding to the second signal is prone to saturation, it is more accurate to distinguish by the first time-domain signal energy value.

Method 3 (a Further Scheme Based on the Method 2)

Figure 12:
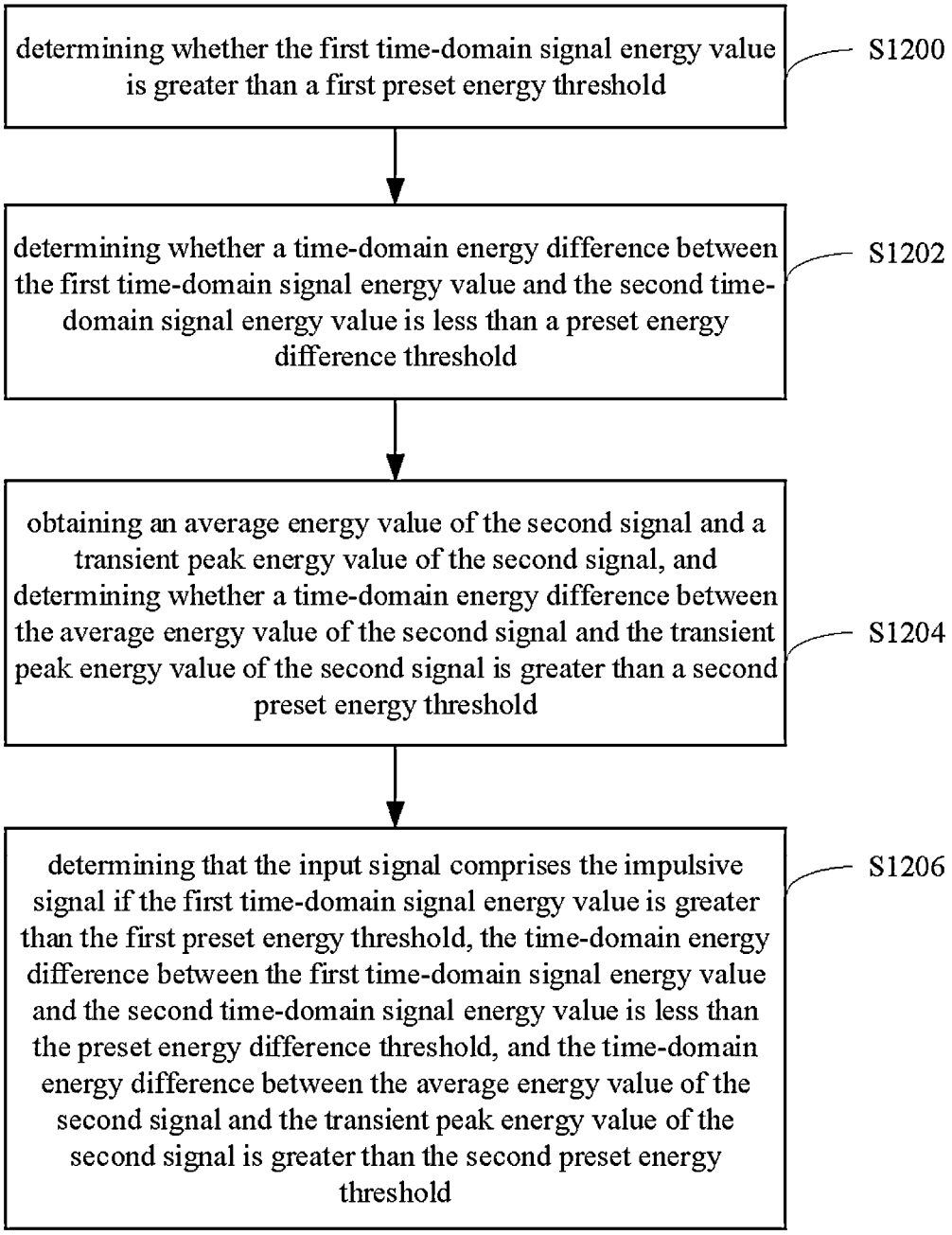
FIG. 12 is another flowchart of step S902 in FIG. 9.

As shown in FIG. 12, the step 902 can comprise steps S1200~S1206, wherein: step S1200, determining whether the first time-domain signal energy value is greater than a first preset energy threshold; step S1202, determining whether a time-domain energy difference between the first time-domain signal energy value and the second time-domain signal energy value is less than a preset energy difference threshold, and the first time-domain signal energy value and the second time-domain signal energy value correspond to a same time window; step S1204, obtaining an average energy value of the second signal and a transient peak energy value of the second signal, and determining whether a time-domain energy difference between the average energy value of the second signal and the transient peak energy value of the second signal is greater than a second preset energy threshold; and step S1206, determining that the input signal comprises the impulsive signal if the first time-domain signal energy value is greater than the first preset energy threshold, the time-domain energy difference between the first time-domain signal energy value and the second time-domain signal energy value is less than the preset energy difference threshold, and the time-domain energy difference between the average energy value of the second signal and the transient peak energy value of the second signal is greater than the second preset energy threshold. Since when there is an impulsive signal, the transient peak energy value of the input signal increases sharply, while the average energy value of the input signal increases relatively slowly. In the embodiment, the comparison between the transient peak energy and long-time average energy is added to further improve the accuracy of determining whether there is an impulsive signal.

In order to further improve the accuracy of determining whether there is an impulsive signal, the input signal can be divided into channels for comprehensive analysis.

Figure 13:
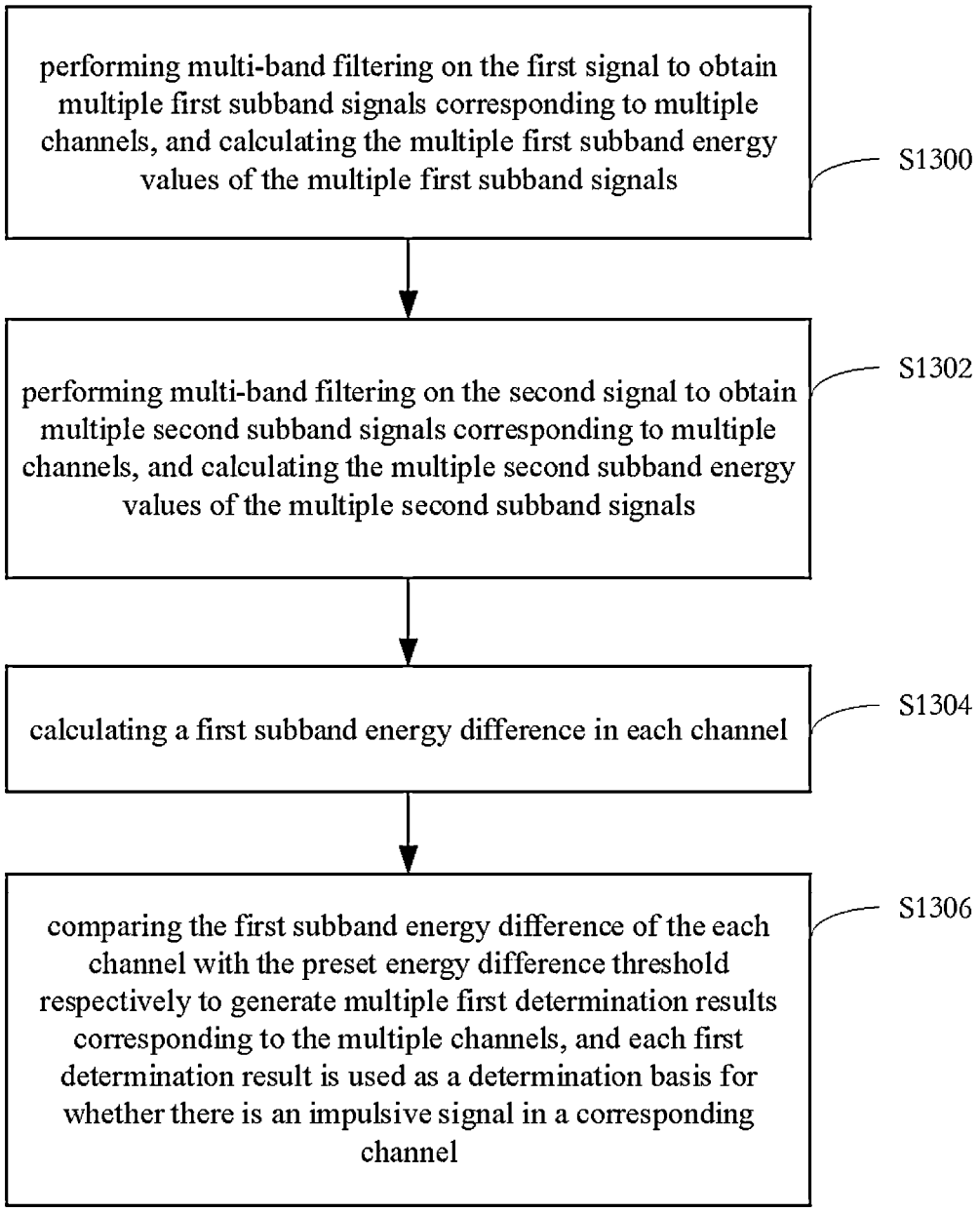
FIG. 13 is a flowchart of step S1204 in FIG. 12.

As an example, the first time-domain signal energy value comprises multiple first subband energy values, and the second time-domain signal energy value comprises multiple second subband energy values. As shown in FIG. 13, the step S1204 can comprises steps S1300~S1306, wherein, step S1300, performing multi-band filtering on the first signal to obtain multiple first subband signals corresponding to multiple channels, and calculating the multiple first subband energy values of the multiple first subband signals; step S1302, performing multi-band filtering on the second signal to obtain multiple second subband signals corresponding to multiple channels, and calculating the multiple second subband energy values of the multiple second subband signals; step S1304, calculating a first subband energy difference in each channel, wherein the first subband energy difference represents an energy difference between a first subband energy value of a corresponding channel and a second subband energy value of the corresponding channel; and step S1306, comparing the first subband energy difference of the each channel with the preset energy difference threshold respectively to generate multiple first determination results corresponding to the multiple channels, and each first determination result is used as a determination basis for whether there is an impulsive signal in a corresponding channel.

Figure 14:
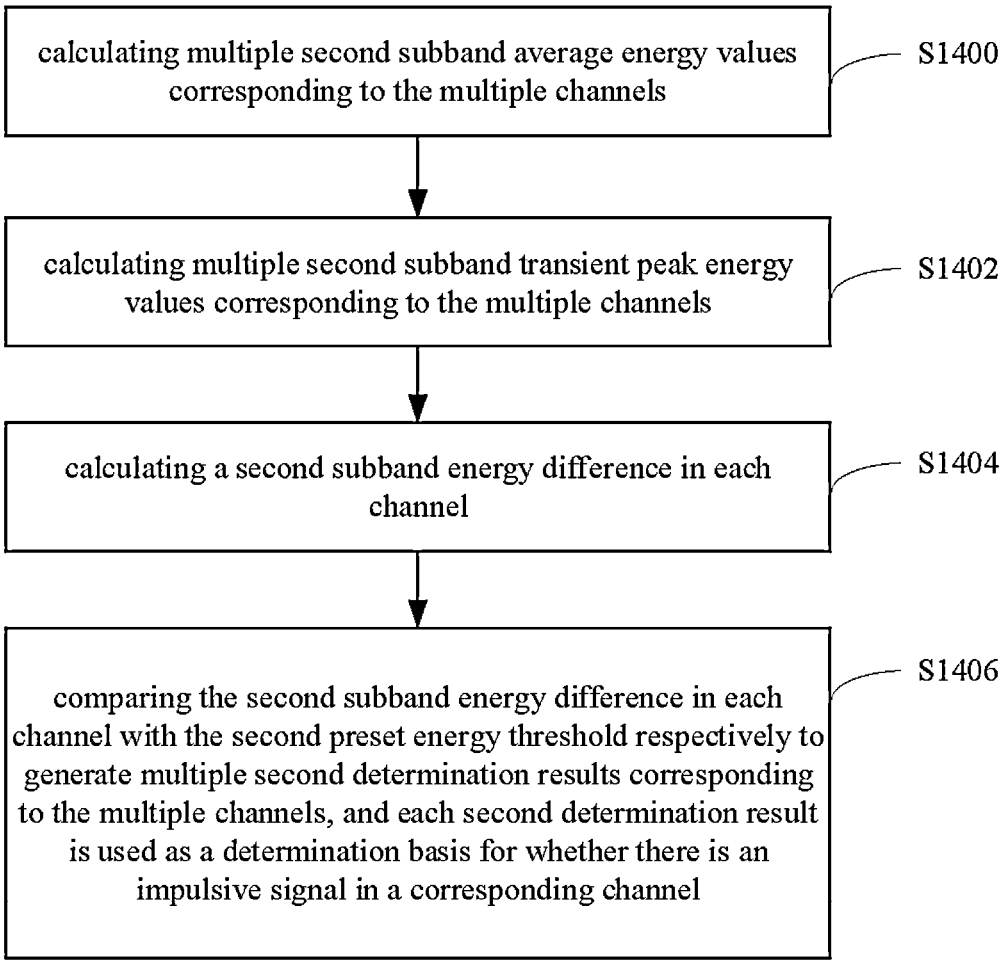
FIG. 14 is another flowchart of step S1204 in FIG. 12.

As an example, the average energy value of the second signal comprises multiple second subband average energy values of the second signal, and the transient peak energy value of the second signal comprises multiple second subband transient peak energy values of the second signal. As shown in FIG. 14, the step S1204 can comprise steps S1400~S1406, wherein: step S1400, calculating multiple second subband average energy values corresponding to the multiple channels; step S1402, calculating multiple second subband transient peak energy values corresponding to the multiple channels; step S1404, calculating a second subband energy difference in each channel, wherein the second subband energy difference represents an energy difference between the second subband average energy value of a corresponding channel and a second subband transient peak energy value of the corresponding channel; step S1406, comparing the second subband energy difference in each channel with the second preset energy threshold respectively to generate multiple second determination results corresponding to the multiple channels, and each second determination result is used as a determination basis for whether there is an impulsive signal in a corresponding channel.

Figure 15:
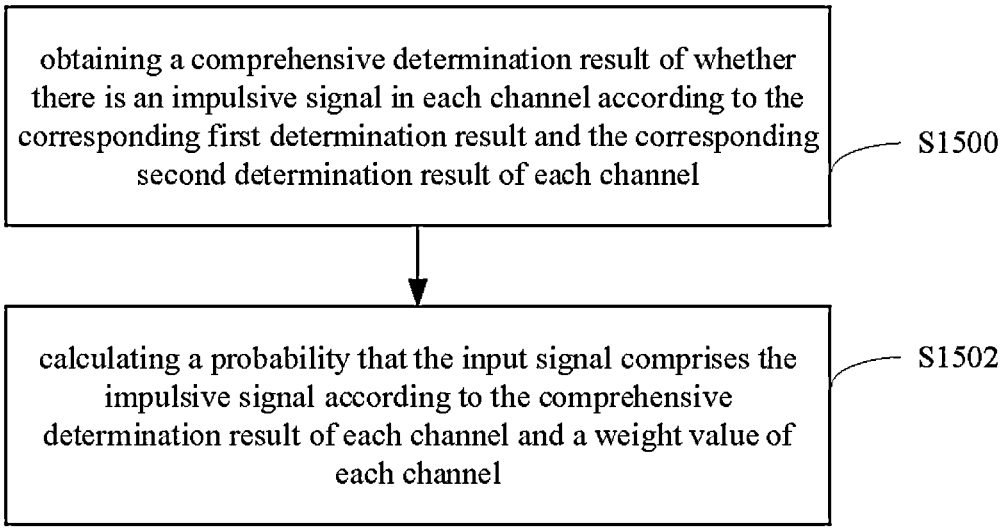
FIG. 15 is a flowchart of step S1206 in FIG. 12.

As an example, as shown in FIG. 15, the step S1206 can comprise steps S1500~S1502, wherein: step S1500, obtaining a comprehensive determination result of whether there is an impulsive signal in each channel according to the corresponding first determination result and the corresponding second determination result of each channel; step S1502, calculating a probability that the input signal comprises the impulsive signal according to the comprehensive determination result of each channel and a weight value of each channel.

Figure 16:
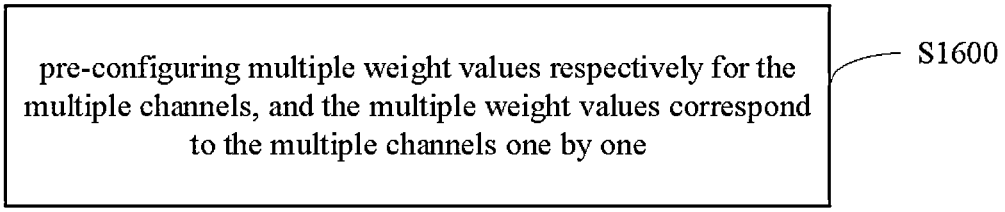
FIG. 16 schematically shows newly added steps of the impulsive noise suppression method based on dual-microphone architecture according to the first embodiment of the present invention.

As an example, as shown in FIG. 16, the method further comprises step S1600, wherein: step S1600, pre-configuring multiple weight values respectively for the multiple channels, and the multiple weight values correspond to the multiple channels one by one; wherein, weight values of each channel higher than a preset frequency point are configured as a first value, weight values of each channel not higher than the preset frequency point are configured as the second value, and the first value is greater than the second value. Since a frequency range covered by the impulsive signal is the whole frequency band, and a voice is mainly concentrated in 300-3400 Hz. Therefore, a weight value can be increased for a determination of channels above 4 kHz.

The weight value of a low-frequency part is low, which can effectively resist the interference of speech and make the determination of impulsive signals more robust.

Embodiment 2

Figure 17:
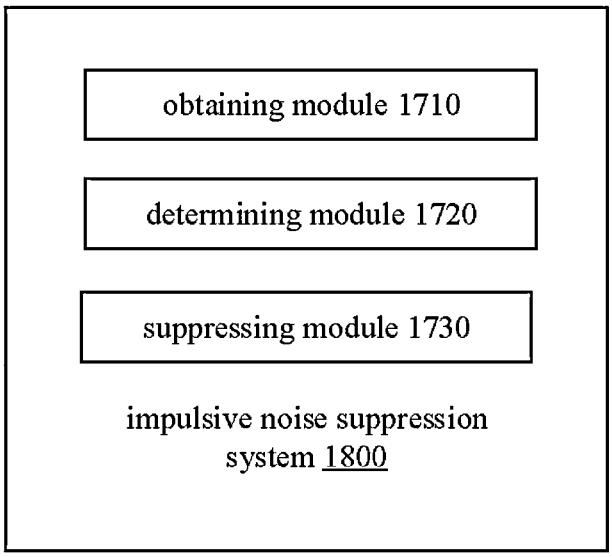
FIG. 17 schematically shows a block diagram of an impulsive noise suppression system based on dual-microphone architecture according to a second embodiment of the present invention.

As shown in FIG. 17, which schematically shows a block diagram of an impulsive noise suppression system 1700 based on dual-microphone architecture according to a second embodiment of the present invention. The impulsive noise suppression system 1700 based on dual-microphone architecture is applied to a hearing aid, and the hearing aid comprises a first feedforward microphone, a second feedforward microphone, and a speaker, and a sensitivity level of the first feedforward microphone is less than a sensitivity level of the second feedforward microphone, the first feedforward microphone and the second feedforward microphone are located on a side of the hearing aid away from an ear canal, and the speaker is located on a side close to the ear canal. The system may be divided into one or more program modules, which are stored in a medium, and executed by one or more processors to implement the embodiment of the present application. The program module referred to in the embodiment of the present application refers to a series of computer program instruction segments capable of accomplishing specific functions. The following description will specifically describe the functions of the program modules of the embodiment.

As shown in FIG. 17, the impulsive noise suppression system 1700 based on dual-microphone architecture can comprise an obtaining module 1710, a determining module 1720, and a suppressing module 1730. Wherein:

The obtaining module 1710, obtaining an input signal, the input signal comprising a first signal provided through the first microphone and a second signal provided through the second feedforward microphone;

The determining module 1720, determining whether the input signal comprises an impulsive signal according to a first time-domain signal energy value of the first signal and a second time-domain signal energy value of the second signal;

The suppressing module 1730, performing an impulsive signal suppression operation on the input signal if the input signal includes the impulsive signal.

Embodiment 3

Figure 18:
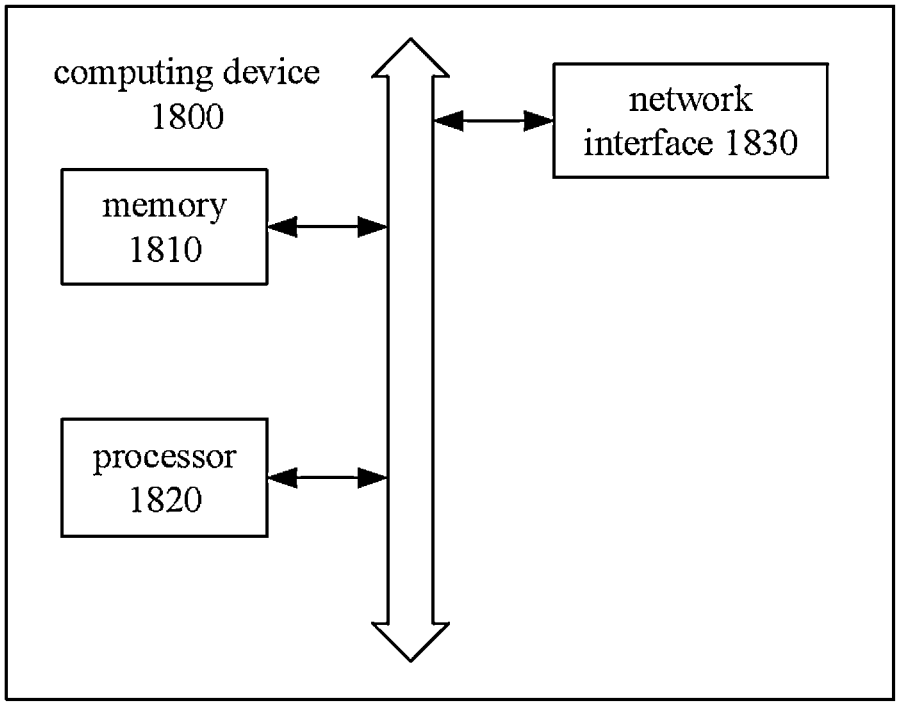
FIG. 18 schematically shows a schematic diagram of the hardware architecture of a computing device suitable for implementing an impulsive noise suppression method based on dual-microphone architecture according to a third embodiment of the present invention.

As shown in FIG. 18, which shows a schematic diagram of the hardware architecture of a computing device 1800 suitable for implementing an impulsive noise suppression method based on dual-microphone architecture according to the third embodiment of the present invention. The computing device 1800 may be a hearing aid or a hearing device with a hearing aid function. In the embodiment, the computing device 1800 is a device capable of automatically performing numerical calculations and/or information processing according to predefined or stored instructions. For example, it can be a hearing aid, a hearing aid with a hearing aid function, and the like. As shown in FIG. 18, the computing device 1800 includes, but is not limited to, a memory 1810, a processor 1820, and a network interface 1830 that can be communicated with each other through a system bus. Of which:

The memory 1810 includes at least one type of computer-readable storage medium. The readable storage medium includes flash memory, hard disk, multimedia card, card type memory (e.g., SD or DX memory, etc.), random access memory (RAM), static random access memory (SRAM), read-only memory (ROM), electrically erasable programmable read-only memory (EEPROM), programmable read-only memory (PROM), magnetic memory, magnetic disk, optical disk, etc. In some embodiments, the memory 1810 may be an internal storage module of the computing device 1800 such as a hard disk or memory of the computing device 1800. In other embodiments, the memory 1810 may also be an external storage device of the computing device 1800, such as a plugged hard disk provided on the computing device 1800, a smart media card (SMC), secure digital (SD) card, a flash memory card, and the like. Of course, the memory 1810 may also include both an internal storage module and an external storage device of the computing device 1800. In the embodiment, the memory 1810 is generally configured to store an operating system and various types of application software installed in the computing device 1800 such as program codes of the network communication method and the like. In addition, the memory 1810 may also be configured to temporarily store various types of data that have been or will be outputted.

The processor 1820, in some embodiments, may be a central processing unit (CPU), a controller, a microprocessor, or other data processing chip. The processor 1820 is generally configured to control the overall operation of the computing device 1800 such as performing control and processing related to data interaction or communication with the computing device 1800. In the embodiment, the processor 1820 is configured to run program code stored in the memory 1810 or process data.

The network interface 1830 may include a wireless network interface or a wired network interface which is generally used to establish a communication connection between the computing device 1800 and other computing devices. For example, the network interface 1830 is used for connecting the computing device 1800 to an external terminal via a network and establishing a data transmission channel and a communication connection between the computing device 1800 and the external terminal. The network can be a wireless or wired network such as an enterprise intranet, an Internet, a Global System of Mobile communication (GSM), a Wideband Code Division Multiple Access (WCDMA), a 4G network, a 5G network, a Bluetooth, Wi-Fi, and the like.

It is to be noted that FIG. 18 shows only a computing device 1800 having components 1810-1830, but it is understood that it is not required to implement all of the shown components and that more or fewer parts can be implemented in lieu thereof.

In the embodiment, an interactive method of bullet screen eggs stored in the memory 1810 may be divided into one or more program modules and executed by one or more processors (processor 1820 in the embodiment) to complete the present application.

Embodiment 4

The embodiment further provides a non-transitory computer-readable storage medium, which stores computer programs, and when the computer programs are executed by a processor, the steps of an impulsive noise suppression method based on a dual-microphone architecture in the embodiment are realized.

In the embodiment, the computer-readable storage medium includes flash memory, hard disk, multimedia card, card type memory (e.g., SD or DX memory, etc.), random access memory (RAM), static random access memory (SRAM), read-only memory (ROM), electrically erasable programmable read-only memory (EEPROM), programmable read-only memory (PROM), magnetic memory, magnetic disk, optical disk, etc. In some embodiments, the computer-readable storage medium may be an internal storage module of the computing device such as a hard disk or memory of the computing device. In other embodiments, the memory may also be an external storage device of the computing device, such as a plugged hard disk provided on the computing device, a smart media card (SMC), secure digital (SD) card, a flash memory card, and the like. Of course, the computer-readable storage medium may also include both an internal storage module and an external storage device of the computing device. In the embodiment, the computer-readable storage medium is generally used to store an operating system and various types of application software installed in the computing device such as program codes of the impulsive noise suppression method based on dual-microphone architecture and the like. In addition, the memory may also be used to temporarily store various types of data that have been or will be outputted.

Embodiment 5

Figure 19:
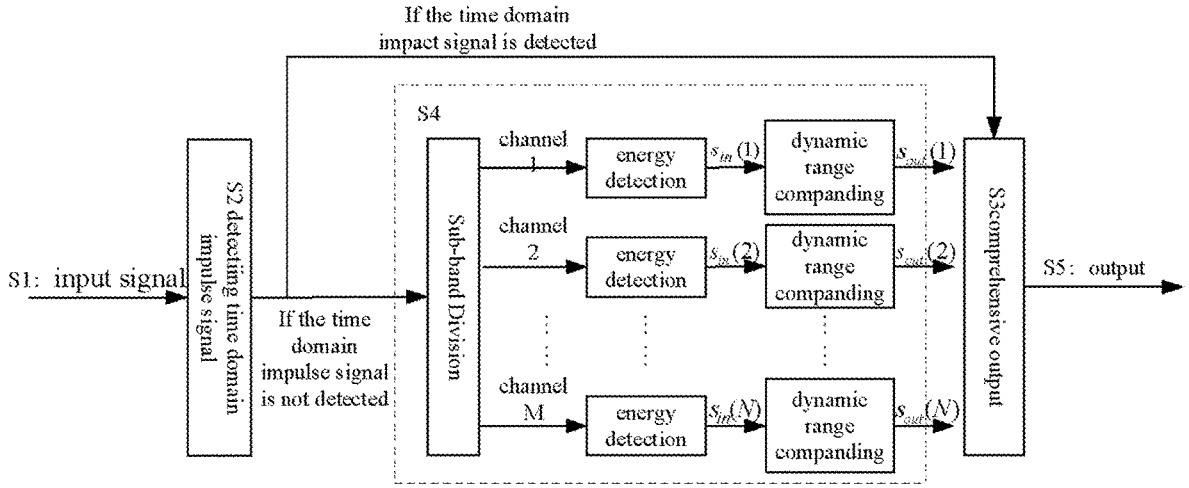
FIG. 19 is a process framework of impulsive noise suppression based on a single-microphone architecture.

FIG. 19 schematically shows a flowchart of an impulsive noise suppression method based on a single-microphone architecture according to the first embodiment of the present invention. As shown in FIG. 19, the impulsive noise suppression method based on the dual-microphone architecture may comprise steps S1~S5, wherein:

S1, obtaining an input signal through the feedforward microphone, the input signal comprising a signal provided from a surrounding environment;

S2, detecting whether the input signal comprises a time-domain impulsive signal;

S3, performing an output gain control on the input signal to obtain a first target signal if the input signal comprises the time-domain impulsive signal;

S4, performing a dynamic range companding control and the output gain control on the input signal in sequence to obtain a second target signal if the input signal does not comprise the time-domain impulsive signal; and S5, outputting the first target signal or the second target signal to the speaker for playing through the speaker.

Figure 20:
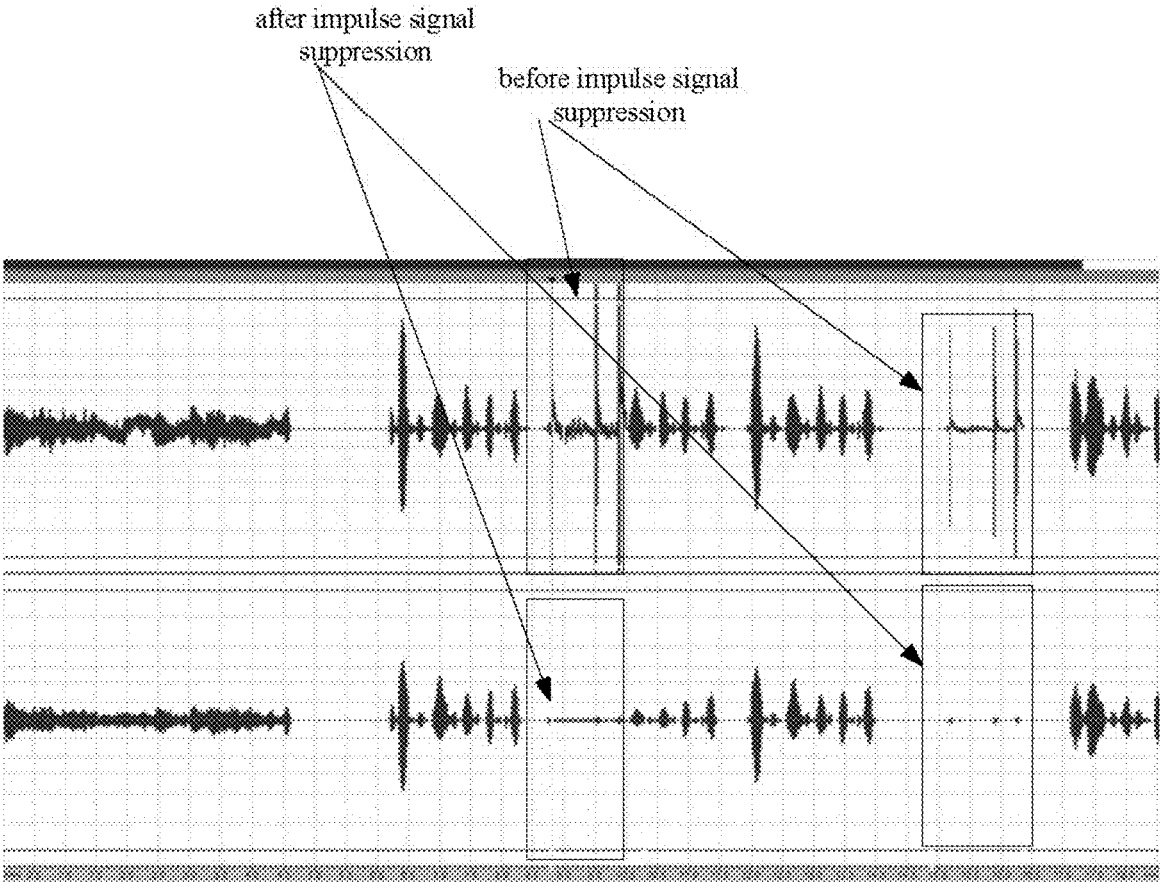
FIG. 20 schematically shows a comparison diagram of effects before and after the impulsive signal is suppressed.

As shown in FIG. 20, it is a graph of the ratio effect before and after using any of the impulsive noise suppression schemes in the first to fifth embodiments.

Apparently, it should be appreciated by those skilled in the art that each module or step described in the embodiment of the present application can be realized by a general-purpose and that the modules or steps may be integrated on a single computing device or distributed on a network consisting of a plurality of computing devices, optionally, the modules or steps may be realized by executable program codes so that the modules or steps can be stored in a storage device to be executed by a computing device, and in some cases, the steps shown or described herein can be executed in a sequence different from this presented herein, or the modules or steps are formed into integrated circuit modules, or several of the modules or steps are formed into integrated circuit modules. Therefore, the present application is not limited to the combination of specific hardware and software.

The embodiments described above are just preferred embodiments of the present application and thus do not limit the patent scope of the present application. Any equivalent structure, or equivalent process transformation made according to the contents of the description and the drawings of the present application or any direct or indirect application to other related arts shall be also included in the patent protection scope of the present application.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An impulsive noise suppression method based on a dual-microphone architecture, applied to a hearing aid, and the hearing aid comprises a first feedforward microphone, a second feedforward microphone, and a speaker, and a sensitivity level of the first feedforward microphone is less than a sensitivity level of the second feedforward microphone, wherein the first feedforward microphone and the second feedforward microphone are located on a side of the hearing aid away from an ear canal, and the speaker is located on a side close to the ear canal, wherein the method comprising:

obtaining an input signal, the input signal comprising a first signal provided through the first microphone and a second signal provided through the second feedforward microphone;

determining whether the input signal comprises an impulsive signal according to a first time-domain signal energy value of the first signal and a second time-domain signal energy value of the second signal; and performing an impulsive signal suppression operation on the input signal if the input signal includes the impulsive signal.

2. The method of claim 1, wherein the step of determining whether the input signal comprises an impulsive signal according to a first time-domain signal energy value of the first signal and a second time-domain signal energy value of the second signal, comprises:

obtaining a time-domain energy difference between the first time-domain signal energy value and the second time-domain signal energy value; wherein the first time-domain signal energy value and the second time-domain signal energy value correspond to a same time window;

determining whether the time-domain energy difference is less than a preset energy difference threshold; and determining that the input signal comprises the impulsive signal if the time-domain energy difference is less than the preset energy difference threshold.

3. The method of claim 1, wherein the step of determining whether the input signal comprises an impulsive signal according to a first time-domain signal energy value of the first signal and a second time-domain signal energy value of the second signal, comprises:

determining whether the first time-domain signal energy value is greater than a first preset energy threshold;

determining whether a time-domain energy difference between the first time-domain signal energy value and the second time-domain signal energy value is less than a preset energy difference threshold, and the first time-domain signal energy value and the second time-domain signal energy value correspond to a same time window; and determining that the input signal comprises the impulsive signal if the first time-domain signal energy value is greater than the first preset energy threshold, and the time-domain energy difference between the first time-domain signal energy value and the second time-domain signal energy value is less than the preset energy difference threshold.

4. The method of claim 1, wherein the step of determining whether the input signal comprises an impulsive signal according to a first time-domain signal energy value of the first signal and a second time-domain signal energy value of the second signal, comprises:

determining whether the first time-domain signal energy value is greater than a first preset energy threshold;

determining whether a time-domain energy difference between the first time-domain signal energy value and the second time-domain signal energy value is less than a preset energy difference threshold, and the first time-domain signal energy value and the second time-domain signal energy value correspond to a same time window;

obtaining an average energy value of the second signal and a transient peak energy value of the second signal, and determining whether a time-domain energy difference between the average energy value of the second signal and the transient peak energy value of the second signal is greater than a second preset energy threshold; and determining that the input signal comprises the impulsive signal if the first time-domain signal energy value is greater than the first preset energy threshold, the time-domain energy difference between the first time-domain signal energy value and the second time-domain signal energy value is less than the preset energy difference threshold, and the time-domain energy difference between the average energy value of the second signal and the transient peak energy value of the second signal is greater than the second preset energy threshold.

5. The method of claim 4, wherein the first time-domain signal energy value comprises multiple first subband energy values, and the second time-domain signal energy value comprises multiple second subband energy values; and the step of determining whether a time-domain energy difference between the first time-domain signal energy value and the second time-domain signal energy value is less than a preset energy difference threshold, comprises:

performing multi-band filtering on the first signal to obtain multiple first subband signals corresponding to multiple channels, and calculating the multiple first subband energy values of the multiple first subband signals;

performing multi-band filtering on the second signal to obtain multiple second subband signals corresponding to multiple channels, and calculating the multiple second subband energy values of the multiple second subband signals;

calculating a first subband energy difference in each channel, wherein the first subband energy difference represents an energy difference between a first subband energy value of a corresponding channel and a second subband energy value of the corresponding channel; and comparing the first subband energy difference of the each channel with the preset energy difference threshold respectively to generate multiple first determination results corresponding to the multiple channels, and each first determination result is used as a determination basis for whether there is an impulsive signal in a corresponding channel.

6. The method of claim 4, wherein the average energy value of the second signal comprises multiple second subband average energy values of the second signal, and the transient peak energy value of the second signal comprises multiple second subband transient peak energy value of the second signal; and the step of obtaining an average energy value of the second signal and a transient peak energy value of the second signal, and determining whether a time-domain energy difference between the average energy value of the second signal and the transient peak energy value of the second signal is greater than a second preset energy threshold, comprises:

calculating multiple second subband average energy values corresponding to the multiple channels;

calculating multiple second subband transient peak energy values corresponding to the multiple channels;

calculating a second subband energy difference in each channel, wherein the second subband energy difference represents an energy difference between the second subband average energy value of a corresponding channel and a second subband transient peak energy value of the corresponding channel;

comparing the second subband energy difference in each channel with the second preset energy threshold respectively to generate multiple second determination results corresponding to the multiple channels, and each second determination result is used as a determination basis for whether there is an impulsive signal in a corresponding channel.

7. The method of claim 6, wherein the step of determining that the input signal comprises the impulsive signal if the first time-domain signal energy value is greater than the first preset energy threshold, the time-domain energy difference between the first time-domain signal energy value and the second time-domain signal energy value is less than the preset energy difference threshold, and the time-domain energy difference between the average energy value of the second signal and the transient peak energy value of the second signal is greater than the second preset energy threshold, comprises:

obtaining a comprehensive determination result of whether there is an impulsive signal in each channel according to the corresponding first determination result and the corresponding second determination result of each channel;

calculating a probability that the input signal comprises the impulsive signal according to the comprehensive determination result of each channel and a weight value of each channel.

8. The method of claim 7, further comprising:

pre-configuring multiple weight values respectively for the multiple channels, and the multiple weight values correspond to the multiple channels one by one; wherein, weight values of each channel higher than a preset frequency point are configured as a first value, weight values of each channel not higher than the preset frequency point are configured as the second value, and the first value is greater than the second value.

9. A computing device, comprising:

a first feedforward microphone;

a second feedforward microphone, wherein a sensitivity level of the first feedforward microphone is less than a sensitivity level of the second feedforward microphone, and wherein the first feedforward microphone and the second feedforward microphone are located on a side of the computing device away from an ear canal, and the speaker is located on a side close to the ear canal;

a speaker;

at least one processor; and at least one memory communicatively coupled to the at least one processor to configure the at least one processor to:

obtain an input signal, the input signal comprising a first signal provided through the first microphone and a second signal provided through the second feedforward microphone;

determine whether the input signal comprises an impulsive signal according to a first time-domain signal energy value of the first signal and a second time-domain signal energy value of the second signal; and perform an impulsive signal suppression operation on the input signal if the input signal includes the impulsive signal.

10. The computing device of claim 9, the at least a memory further configuring the at least a processor to:

obtain a time-domain energy difference between the first time-domain signal energy value and the second time-domain signal energy value; wherein the first time-domain signal energy value and the second time-domain signal energy value correspond to a same time window;

determine whether the time-domain energy difference is less than a preset energy difference threshold; and determine that the input signal comprises the impulsive signal if the time-domain energy difference is less than the preset energy difference threshold.

11. The computing device of claim 9, the at least a memory further configuring the at least a processor to:

determine whether the first time-domain signal energy value is greater than a first preset energy threshold;

determine whether a time-domain energy difference between the first time-domain signal energy value and the second time-domain signal energy value is less than a preset energy difference threshold, and the first time-domain signal energy value and the second time-domain signal energy value correspond to a same time window; and determine that the input signal comprises the impulsive signal if the first time-domain signal energy value is greater than the first preset energy threshold, and the time-domain energy difference between the first time-domain signal energy value and the second time-domain signal energy value is less than the preset energy difference threshold.

12. The computing device of claim 9, the at least a memory further configuring the at least a processor to:

determine whether the first time-domain signal energy value is greater than a first preset energy threshold;

determine whether a time-domain energy difference between the first time-domain signal energy value and the second time-domain signal energy value is less than a preset energy difference threshold, and the first time-domain signal energy value and the second time-domain signal energy value correspond to a same time window;

obtain an average energy value of the second signal and a transient peak energy value of the second signal, and determine whether a time-domain energy difference between the average energy value of the second signal and the transient peak energy value of the second signal is greater than a second preset energy threshold; and determine that the input signal comprises the impulsive signal if the first time-domain signal energy value is greater than the first preset energy threshold, the time-domain energy difference between the first time-domain signal energy value and the second time-domain signal energy value is less than the preset energy difference threshold, and the time-domain energy difference between the average energy value of the second signal and the transient peak energy value of the second signal is greater than the second preset energy threshold.

13. The computing device of claim 12, wherein the first time-domain signal energy value comprises multiple first subband energy values, and the second time-domain signal energy value comprises multiple second subband energy values; and the at least a memory further configuring the at least a processor to:

perform multi-band filtering on the first signal to obtain multiple first subband signals corresponding to multiple channels, and calculate the multiple first subband energy values of the multiple first subband signals;

perform multi-band filtering on the second signal to obtain multiple second subband signals corresponding to multiple channels, and calculate the multiple second subband energy values of the multiple second subband signals;

calculate a first subband energy difference in each channel, wherein the first subband energy difference represents an energy difference between a first subband energy value of a corresponding channel and a second subband energy value of the corresponding channel; and compare the first subband energy difference of the each channel with the preset energy difference threshold respectively to generate multiple first determination results corresponding to the multiple channels, and each first determination result is used as a determination basis for whether there is an impulsive signal in a corresponding channel.

14. The computing device of claim 12, wherein the average energy value of the second signal comprises multiple second subband average energy values of the second signal, and the transient peak energy value of the second signal comprises multiple second subband transient peak energy value of the second signal; the at least a memory further configuring the at least a processor to:

calculate multiple second subband average energy values corresponding to the multiple channels;

calculate multiple second subband transient peak energy values corresponding to the multiple channels;

calculate a second subband energy difference in each channel, wherein the second subband energy difference represents an energy difference between the second subband average energy value of a corresponding channel and a second subband transient peak energy value of the corresponding channel;

compare the second subband energy difference in each channel with the second preset energy threshold respectively to generate multiple second determination results corresponding to the multiple channels, and each second determination result is used as a determination basis for whether there is an impulsive signal in a corresponding channel.

15. The computing device of claim 14, the at least a memory further configuring the at least a processor to:

obtain a comprehensive determination result of whether there is an impulsive signal in each channel according to the corresponding first determination result and the corresponding second determination result of each channel;

calculate a probability that the input signal comprises the impulsive signal according to the comprehensive determination result of each channel and a weight value of each channel.

16. The computing device of claim 15, the at least a memory further configuring the at least a processor to:

pre-configure multiple weight values respectively for the multiple channels, and the multiple weight values correspond to the multiple channels one by one; wherein, weight values of each channel higher than a preset frequency point are configured as a first value, weight values of each channel not higher than the preset frequency point are configured as the second value, and the first value is greater than the second value.

17. An impulsive noise suppression method based on a single-microphone architecture, applied to a hearing aid, wherein the hearing aid comprises a feedforward microphone and a speaker electrically connected in sequence, wherein the feedforward microphone is located on a side of the hearing aid away from an ear canal, and the speaker is located on a side close to the ear canal, and the method comprising:

obtaining an input signal through the feedforward microphone, the input signal comprising a signal provided from a surrounding environment;

detecting whether the input signal comprises a time-domain impulsive signal;

performing an output gain control on the input signal to obtain a first target signal if the input signal comprises the time-domain impulsive signal;

performing a dynamic range companding control and the output gain control on the input signal in sequence to obtain a second target signal if the input signal does not comprise the time-domain impulsive signal; and outputting the first target signal or the second target signal to the speaker for playing through the speaker.

* * * * *